United States Patent [19]

Husslein

[11] Patent Number: 4,645,911

[45] Date of Patent: Feb. 24, 1987

[54] HEATING DEVICE FOR RADIATION HEATING UNITS HEATED BY ELECTRIC ENERGY

[75] Inventor: Julius Husslein, Vachendorf, Fed. Rep. of Germany

[73] Assignee: Bosch-Siemens Hausgeraete GmbH, Stuttgart, Fed. Rep. of Germany

[21] Appl. No.: 705,090

[22] Filed: Feb. 25, 1985

[30] Foreign Application Priority Data

Feb. 23, 1984 [DE] Fed. Rep. of Germany ..... 3406604

[51] Int. Cl.[4] ..... H05B 3/68

[52] U.S. Cl. ..... 219/464; 219/347; 219/461

[58] Field of Search ..... 219/347, 388, 411, 449, 219/450, 456, 461, 462, 464, 553; 313/315

[56] References Cited

U.S. PATENT DOCUMENTS

| | | | |
|---|---|---|---|
| 3,005,081 | 10/1961 | Kordes et al. | 219/450 X |
| 3,249,741 | 5/1966 | Mills | 219/388 |
| 3,304,406 | 2/1967 | King | 219/411 |
| 3,355,574 | 11/1967 | Bassett, Jr. | 219/464 |
| 3,407,285 | 10/1968 | Jacobs | 219/456 |
| 3,579,021 | 5/1971 | Kimball | 313/315 X |
| 3,627,989 | 12/1971 | Heldler et al. | 219/464 X |
| 3,663,798 | 5/1972 | Speidel et al. | 219/464 |
| 4,069,437 | 1/1978 | Notelteirs et al. | 313/315 |
| 4,350,875 | 9/1982 | McWilliams | 219/449 |

FOREIGN PATENT DOCUMENTS

| | | | |
|---|---|---|---|
| 2809131 | 9/1979 | Fed. Rep. of Germany | 219/464 |

*Primary Examiner*—E. A. Goldberg
*Assistant Examiner*—Teresa J. Walberg
*Attorney, Agent, or Firm*—Herbert L. Lerner; Laurence A. Greenberg

[57] ABSTRACT

A heating device for radiation heating units heated by electric energy includes a radiation heating region and a combination of high-temperature radiation heating elements and normal-temperature radiation heating elements disposed in the heating region.

13 Claims, 4 Drawing Figures

HEATING DEVICE FOR RADIATION HEATING UNITS HEATED BY ELECTRIC ENERGY

SPECIFICATION

The invention relates to a heating device for radiation heating units which are heated by electric energy.

Heating devices of this type are usually constructed in such a way that the radiation heating elements which are operated by electric energy are disposed below a diathermic or permeable plate, such as a glass-ceramic plate. The radiation heating elements are normally heating coils which are mounted in such a way as to be freely exposed on a temperature-resistant, temperature-insulating, and electrically non-conducting material. In order to prevent rapid deterioration due to the surrounding atmosphere, such heating elements are usually constructed for an operating temperature of up to 1000° C., and are also operated at this temperature. It is conventional to place two heating circuits within the heating region of a heating unit, wherein one heating region has a heating circuit with a higher power rating that can be regulated with regard to its electrical power consumption and therefore with regard to its thermal power output. The other heating region usually has a heating circuit with a lower power rating that is added to the first heat circuit with its full nominal power for special load requirements, such as in order to start the cooking process.

It is also known to use elements as radiation heating elements for heating units which are protected by a protective gas, such as halogen-protected radiation heating elements, which can be operated with considerably higher temperatures, for instance up to 2000° C., due to the use of the protective gas. This type of radiation element is more costly than the widely used normal-temperature radiation heating element which can be exposed to the surrounding atmosphere, at least with respect to the manufacture thereof. However, high temperature radiation heating elements have special radiation capabilities well known in the field of radiation technology.

It is accordingly an object of the invention to provide a heating device for radiation heating units heated by electric energy, which overcomes the hereinafore-mentioned disadvantages of the heretofore-known devices of this general type, which is advantageous with respect to its construction and control ability and which is well suited for advantageously functioning under most varied applications and operating conditions.

With the foregoing and other objects in view there is provided, in accordance with the invention, a heating device for radiation heating units heated by electric energy, comprising a radiation heating region and a combination of high-temperature radiation heating elements and normal-temperature radiation heating elements disposed in the heating region.

In accordance with another feature of the invention, the high-temperature radiation heating elements are surrounded by a protective gas in glass-ceramic rods. Halogens can be used as the protective gas.

In accordance with a further feature of the invention, the high-temperature radiation heating elements operate at a temperature of approximately 2000° C.

In accordance with an added feature of the invention, the normal-temperature radiation heating elements are exposed to the surrounding atmosphere.

In accordance with an additional feature of the invention, the normal-temperature radiation heating elements operate at a temperature of approximately 1000° C.

The use of a combination of high-temperature radiation heating elements and normal-temperature radiation heating elements in one radiation heating unit combines the advantageous properties of the two heating systems in a practical way, so that they augment each other. Accordingly, the two kinds of radiation heating elements are used for different operating and control functions. For example, the normal-temperature radiation heating elements are used to satisfy the basic operating load for cooking or frying, wherein the thermic inertia of the heating systems is very well suited for the cooking process. Meanwhile, the high-temperature radiation heating elements are used for normally short, peak-load conditions, such as during the start of the cooking process. In this case, the relative low thermic inertia of this radiation heating element is a positive advantage for the heating process, up to the point in time when the nominal cooking temperature is reached.

In accordance with again another feature of the invention, the normal-temperature radiation heating elements are constructed for connection to an electric power supply of up to approximately 1500 Watts.

In accordance with again a further feature of the invention, the high-temperature radiation heating elements are constructed for connection to an electric power supply of up to approximately 700 Watts. These values are suited for regular cooking and frying operations.

In accordance with again an added feature of the invention, the normal-temperature radiation heating elements and the high-temperature radiation heating elements are individually supplied with electric energy from associated control devices.

In accordance with again an additional feature of the invention, the normal-temperature radiation heating elements are supplied with regulated and/or controlled electric energy, and the high-temperature radiation heating elements are supplied with constant electric energy. For this application, the normal-temperature radiation heating elements are operated with the well known and proven regulation and control measures which conform to the connection requirements of the power supply network as well as to the requirements of the heating function. In contrast, the high-temperature radiation heating elements are added to the circuit with their full power, as required.

In accordance with yet another feature of the invention, the normal-temperature radiation heating elements and the high-temperature radiation heating elements are symmetrically disposed in the heating region.

In accordance with yet a further feature of the invention, the high-temperature radiation heating elements as well as the normal-temperature radiation heating elements are substantially uniformly distributed over the heating region.

In accordance with yet an added feature of the invention, the normal-temperature radiation heating elements and the high-temperature radiation heating elements are alternatingly disposed in the heating region. This is advantageous according to heat technology practice. A spiral or annular configuration may be used advantageously.

In accordance with a concomitant feature of the invention, there is provided a layer or reflector disposed at least below the high-temperature radiation elements, i.e. in the bottom region of the heating element carrier, for reflecting radiation heat or temperature.

This leads to improved utilization of the radiated heat energy, in particular the heating energy radiated by the high-temperature radiation heating element.

Other features which are considered as characteristic for the invention are set forth in the appended claims.

Although the invention is illustrated and described herein as embodied in a heating device for radiation heating units heated by electric energy, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Referring now in detail to FIGS. 1–4 of the drawings as a whole, there are seen radiation heating regions 1, 11, 21 in which high-temperature radiation heating elements 2, 12, 22 and normal-temperature radiation heating elements 3, 13, 23, 23' are disposed side by side. According to FIG. 1, the high-temperature radiation heating element 2 is constructed in form of a rod, while according to FIGS. 3 and 4, annular high-temperature radiation heating elements are disposed within the radiation heating unit.

The high temperature radiation heating elements 2, 12, 22 are constructed in the conventional manner, wherein a heating wire, which may be made of tungsten, is hermetically surrounded by a glass-ceramic tube which is filled with a protective gas, such as a halogen, for protection of the heating wire. High-temperature radiation heating elements of this type can be operated at an operating temperature of about 2000° C.

The normal-temperature heating elements 3, 13, 23, 23' are spiral in shape and are freely exposed in the radiation heating unit, so that they are exposed to the surrounding atmosphere. The practical operating temperature is therefore limited to about 1000° C.

Figure 2:
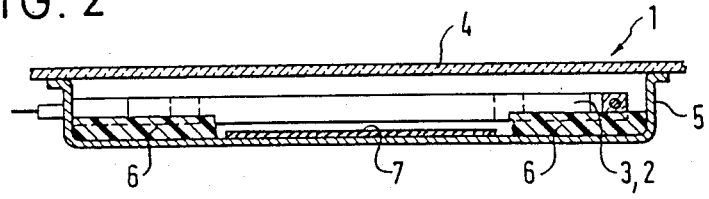
FIG. 2 is a cross-sectional view of the radiation heating unit taken along the line II—II in FIG. 1.
Figure 3:
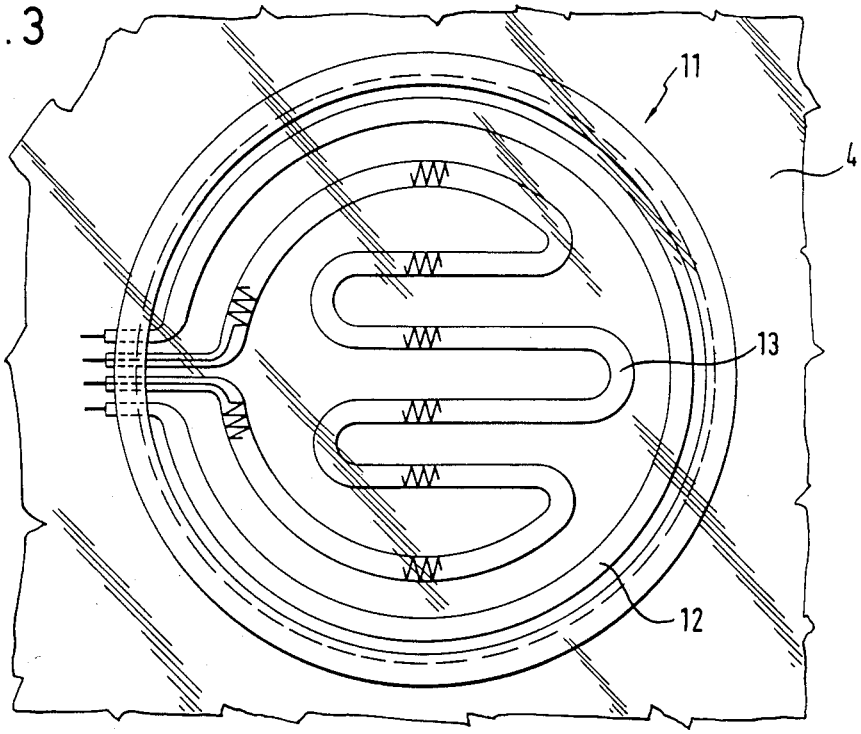
FIGS. 3 and 4 are top plan views of radiation heating units with differently configured heating elements.
Figure 4:
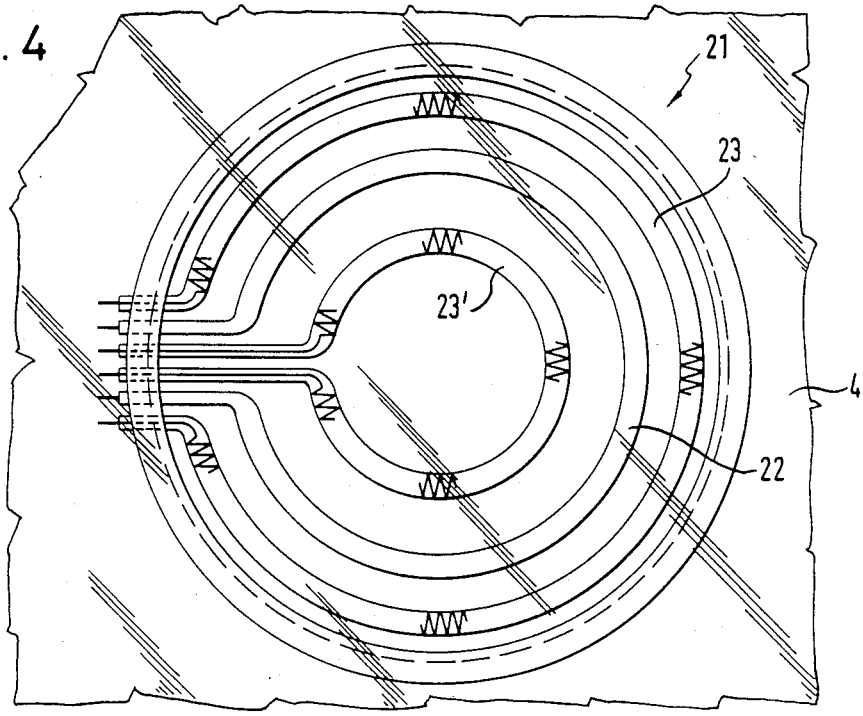

FIG. 2 shows that the radiation heating elements 3, 2 are disposed in one plane below a glass-ceramic plate 4 within a housing tray 5. In this manner, the glass-ceramic plate has good transmission properties for heat radiation. The normal-temperature heating element 3 is disposed in a temperature-resistant, heat-insulating and electrically non-conducting material 6. However, the high-temperature radiation heating element 2 is only supported at given locations, and projects in a freely-exposed manner over wide portions of the length thereof. This makes it possible to place a radiation reflector 7 below the high-temperature radiation heating element, which upwardly reflects the heat energy that is radiated downward from the high temperature radiation element. An efficient utilization of the radiation heat is thus accomplished.

Figure 1:
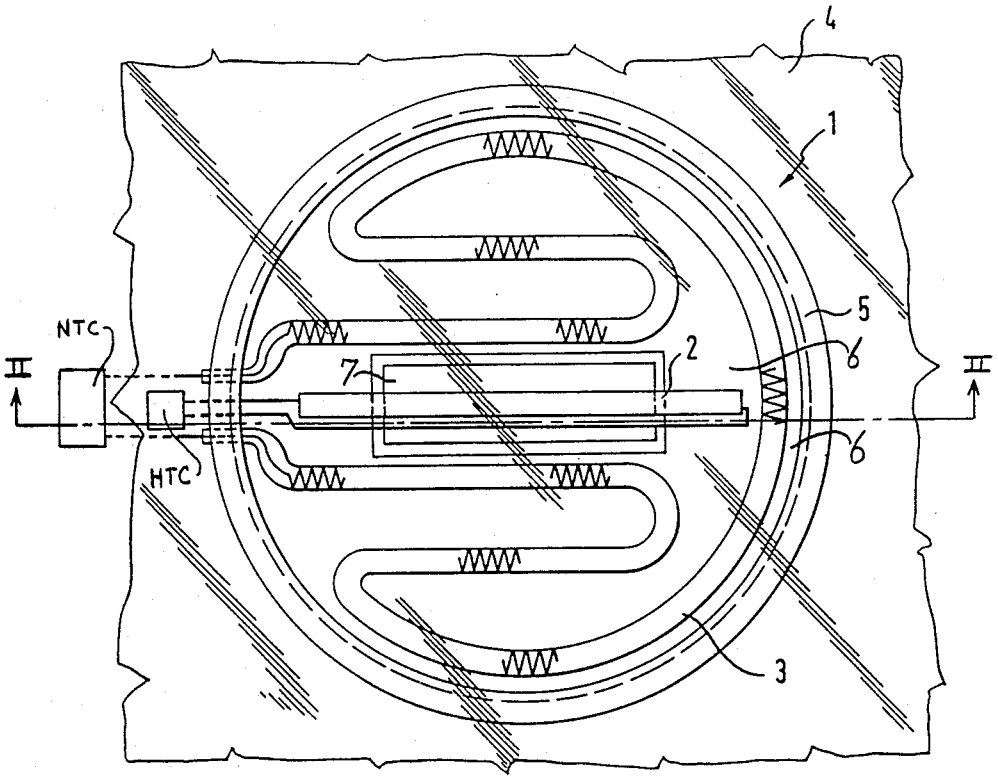
FIG. 1 is a diagrammatic, top plan view of a radiation heating unit according to the invention.

As seen in FIG. 1, a high-temperature control HTC is connected to the high-temperature heating elements 2 for supplying approximately 700 Watts of electric energy in a constant manner. A normal-temperature control NTC associated with the control HTC is connected to the normal-temperature heating elements 3 for supplying approximately 1500 Watts of electric energy in a regulated or controlled manner.

The foregoing is a description corresponding in substance to German Application No. P 34 06 604.7, filed Feb. 23, 1984, the international priority of which is being claimed for the instant application, and which is hereby made part of this application. Any material discrepancies between the foregoing specification and the corresponding aforementioned German application are to be resolved in favor of the latter.

I claim:

1. Heating device, comprising a pot-shaped heating unit support, at least two radiation heating units heated by electric energy and disposed in said heating unit support, at least one of said heating units being a high-temperature radiation heating element and at least one of said heating units being a normal-temperature radiation heating element, said normal-temperature heating element being exposed to ambient air, an enclosure surrounding said high-temperature radiation heating element, a protective gas disposed in said enclosure, said enclosure and said normal-temperature radiation heating element being mutually spaced apart defining an unobstructed space therebetween, and a planar support surface defining a single heating zone disposed above both of said heating units for supporting containers for food to be heated.

2. Heating device according to claim 1, wherein said high-temperature radiation heating elements operate at a temperature of approximately 2000° C.

3. Heating device according to claim 2, wherein said normal-temperature radiation heating elements operate at a temperature of approximately 1000° C.

4. Heating device according to claim 1, wherein said normal-temperature radiation heating elements are exposed to the surrounding atmosphere.

5. Heating device according to claim 1, wherein said normal-temperature radiation heating elements operate at a temperature of approximately 1000° C.

6. Heating device according to claim 1, wherein said normal-temperature radiation heating elements are constructed for connection to an electrical supply of up to approximately 1500 Watts.

7. Heating device according to claim 1, wherein said high-temperature radiation heating elements are constructed for connection to an electrical supply of up to approximately 700 Watts.

8. Heating device according to claim 1, wherein said normal-temperature radiation heating elements and said high-temperature radiation heating elements are individually supplied with electric energy from associated control devices.

9. Heating device according to claim 1, wherein said normal-temperature radiation heating elements are supplied with regulated electric energy, and said high-temperature radiation heating elements are supplied with constant electric energy.

10. Heating device according to claim 1, wherein said normal-temperature radiation heating elements and said high-temperature radiation heating elements are symmetrically disposed in said heating region.

11. Heating device according to claim 1, wherein said high-temperature radiation heating elements as well as said normal-temperature radiation heating elements are substantially uniformly distributed over said heating region.

12. Heating device according to claim 1, wherein said normal-temperature radiation heating elements and said high-temperature radiation heating elements are alternatingly disposed in said heating region.

13. Heating device according to claim 1, including a layer disposed at least below said high-temperature radiation heating elements on said heating unit support for reflecting radiation heat.

* * * * *